United States Patent [19]

Shimizu et al.

[11] Patent Number: 4,956,578

[45] Date of Patent: Sep. 11, 1990

[54] SURFACE CONDUCTION ELECTRON-EMITTING DEVICE

[75] Inventors: Akira Shimizu, Inagi; Hidetoshi Suzuki, Atsugi; Masahiko Okunuki, Tokyo; Haruhito Ono, Ashigara; Ichiro Nomura, Yamato; Yoshikazu Banno, Atsugi; Toshihiko Takeda, Tokyo; Tetsuya Kaneko, Yokohama, all of Japan

[73] Assignee: Canon Kabushiki Kaisha, Tokyo, Japan

[21] Appl. No.: 224,912

[22] Filed: Jul. 27, 1988

[30] Foreign Application Priority Data

| | | | |
|---|---|---|---|
| Jul. 28, 1987 | [JP] | Japan | 62-186648 |
| Jun. 10, 1988 | [JP] | Japan | 63-141562 |
| Jun. 10, 1988 | [JP] | Japan | 63-141563 |

[51] Int. Cl.[5] ..... H01J 29/96

[52] U.S. Cl. ..... 315/3

[58] Field of Search ..... 315/1, 3, 14, 15, 16; 313/306, 311, 448, 458

[56] References Cited

U.S. PATENT DOCUMENTS

| | | | |
|---|---|---|---|
| 3,978,364 | 8/1976 | Dimeff et al. | 313/306 |
| 4,810,934 | 3/1989 | Shimoda et al. | 315/117 X |

*Primary Examiner*—David Mis

*Attorney, Agent, or Firm*—Fitzpatrick, Cella, Harper & Scinto

[57] ABSTRACT

A surface conduction electron-emitting device includes a high-potential electrode provided on a substrate surface, an electron-emitting region provided in contact with the periphery of an exposed part of the high-potential electrode, and a low-potential electrode in contact with the periphery of the electron-emitting region. The low-potential electrode may project upward in the thickness direction of the substrate to a higher level than the high-potential electrode. A device for applying a voltage may further provided between the high-potential electrode and low-potential electrode. The low-potential electrode may be divided into plural numbers and potential may be applied to each of the low-potential electrodes independently.

22 Claims, 13 Drawing Sheets

SURFACE CONDUCTION ELECTRON-EMITTING DEVICE

BACKGROUND OF THE INVENTION

1. Field of the Invention

The present invention relates to an electron-emitting device, and more particularly to a surface conduction electron-emitting device that emits electrons when an electric current flows in a highly resistant thin film.

2. Related Background Art

A device capable of emitting of electrons with a simple structure is the cold cathode device reported by M. I. Elinson et al (Radio Eng. Electron Phys., VOL. 10, pp.1290–1296, 1965).

This device utilizes the phenomenon that electron emission is caused by transmitting an electric current to a thin film formed with a small area on a substrate and in parallel to the surface of the film, and is generally called a surface conduction electron-emitting device.

Surface conduction electron emitting devices that has been reported includes those employing a $SnO_2(Sb)$ thin film developed by Elinson et al., those employing an Au thin film. (G. Dittmer, "Thin Solid Films", Vol. 9, p.317, 1972), those comprising an ITO thin film, (M. Hartwell and C. G. Fonstad, "IEEE Trans. ED Conf.", p.519, 1975), and those comprising a carbon thin film [Hisaji Araki, "SHINKU" (Vacuum). Vol. 26, No. 1, p.22. 1983].

A typical device constitution of these surface conduction electron-emitting devices is shown in FIG. 17. In FIG. 17, a conventional surface conduction electron emitting device comprises an insulating substrate 5 having thereon a highly resistant thin film 4 provided between a high-potential electrode 1 and a low-potential electrode 2. A where a voltage is applied from an external electric source 3 and thereby electrons are emitted from the highly resistant thin film 4.

In these surface conduction electron-emitting devices, it has been hitherto practiced to previously form an electron-emitting region 4 (a high-resistance thin film) by an energizing heat treatment, called "forming", before effecting the electron emission. More specifically, a voltage is applied between the above electrode 1 and electrode 2 to energize the thin film formed with an electron-emitting material to bring the thin film to be locally destroyed, deformed or denatured owing to the Joule heat thereby generated, thus forming the electron-emitting region 4 (a high-resistance thin film) kept in a state of electrically high resistance to obtain an electron-emitting function.

However, such a conventional surface conduction electron-emitting device has the following disadvantages.

(1) The light-emitting region flickers.

(2) As shown in FIG. 18, the electron beam tends to deflect by the distance L toward the high-potential electrode 1 side, and in general the beam diverges.

(3) Accordingly, as shown in FIG. 19 it is necessary to externally provide a focusing lens system to effect the focusing of the electron beam. This, however, requires the preparation of external focusing lenses 17 and 18, requiring an additional step.

(4) A complicated operation is required to obtain axial alignment on the basis of electron optics between the outer focusing lenses 17 and 18 and the surface conduction electron-emitting device.

SUMMARY OF THE INVENTION

An object of the present invention is to provide a surface conduction electron emitting device that can solve the problems as mentioned above, caused by the insufficiency in the focusing performance, and to achieve a good beam-focusing performance without requiring any external focusing lenses 17 and 18.

The above object can be achieved by the invention as described below.

According to an aspect of the present invention, there is provided a surface conduction electron-emitting device comprising a high-potential electrode provided on a substrate surface, an electron-emitting region provided in contact with the periphery of an exposed part of the high-potential electrode, and a low-potential electrode further provided in contact with the periphery of said electron-emitting region.

According to another aspect of the present invention, there is provided a surface conduction electron emitting device comprising a high-potential electrode provided on a substrate surface, an electron-emitting region provided in contact with the periphery of an exposed part of the high-potential electrode, and a low-potential electrode further provided in contact with the periphery of the electron-emitting region in such a manner that it projects upward in the thickness direction of the substrate to a higher level than the high-potential electrode.

According to a further aspect of the present invention, there is provided a surface conduction electron-emitting device comprising a high-potential electrode provided on a substrate surface, an electron-emitting region provided in contact with the periphery of an exposed part of the high-potential electrode a low-potential electrode further provided in contact with the periphery of the said electron-emitting region, and a means for applying a voltage between the high-potential electrode and low-potential electrode.

According to a still further aspect of the present invention, there is provided a surface conduction electron-emitting device comprising a high-potential electrode provided on a substrate surface, an electron-emitting region provided in contact with the periphery of an exposed part of the high-potential electrode, a plurality of low-potential electrodes provided in contact with the periphery of the electron-emitting region, and a means for applying different potential independently to each of the low-potential electrodes

DETAILED DESCRIPTION OF THE PREFERRED EMBODIMENTS

The present invention will be specifically described below with reference to the accompanying drawings.

Figure 1:
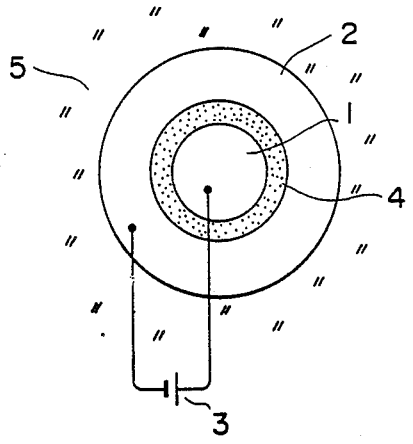
FIG. 1, FIG. 3 to FIG. 8B, and FIG. 10A to FIG. 14 are views illustrating surface conduction electron-emitting devices of the present invention.

FIG. 1 is a basic block diagram illustrating an example of the surface conduction electron-emitting device of the present Invention. In FIG. 1, the surface conduction electron-emitting device of the present invention comprises a pair of electrodes, of which a high-potential electrode having a round shape and feeding an electric current to an electron-emitting region 4 is concentrically provided on its periphery with the electron-emitting region 4, and a low-potential electrode is similarly concentrically provided around the electron-emitting region 4.

Figure 17:
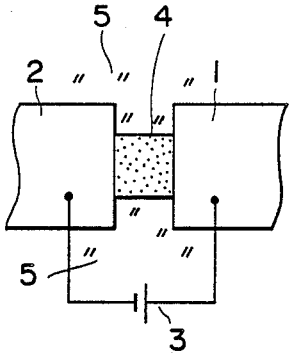
FIG. 17 PRIOR ART
FIG. 17 and FIG. 19 are views illustrating a conventional surface conduction electron-emitting device.
Figure 18:
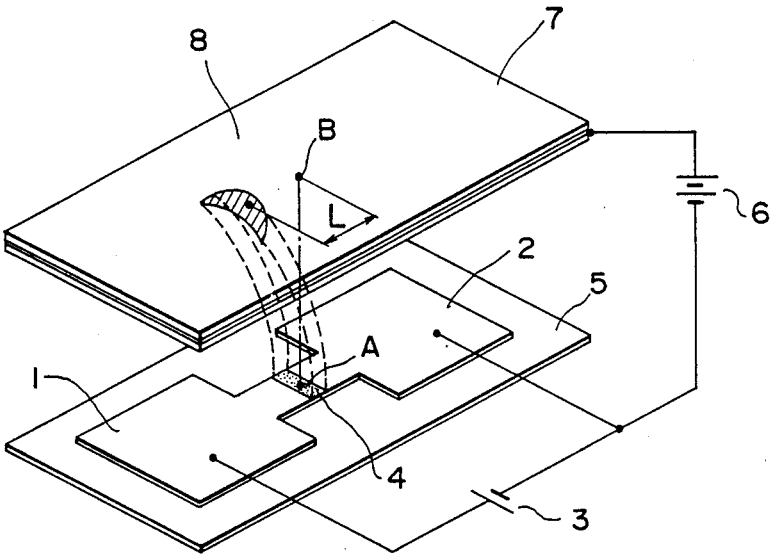
FIG. 18 is a view explanatory of how electrons are emitted from the conventional surface conduction electron-emitting device.

In such constitution, the potential is constant everywhere on the respective electrodes. In the conventional surface conduction electron emitting device illustrated in FIG. 17, the high-potential electrode 1 and the low-potential electrode 2 are separated right and left to form line symmetry, while in the device of the present invention illustrated in FIG. 1, the electrodes form center symmetry and rotation symmetry to bring about remarkably high symmetricalness as a whole. For this reason, the velocity distribution of the electrons to be emitted may be neither irregular nor deflected in contrast with the prior art. Rather, the velocity distribution of the electrons is uniform and his center symmetricalness and rotation symmetricalness, so that the electron beam emitted from the surface conduction electron emitting device can be focused at a particular position, i.e.. a spot located in a direction perpendicular to the center of the device. Moreover, the electron beam exhibits a decrease in flickering due to the substantial increase of the area of the light-emitting region.

Figure 2:
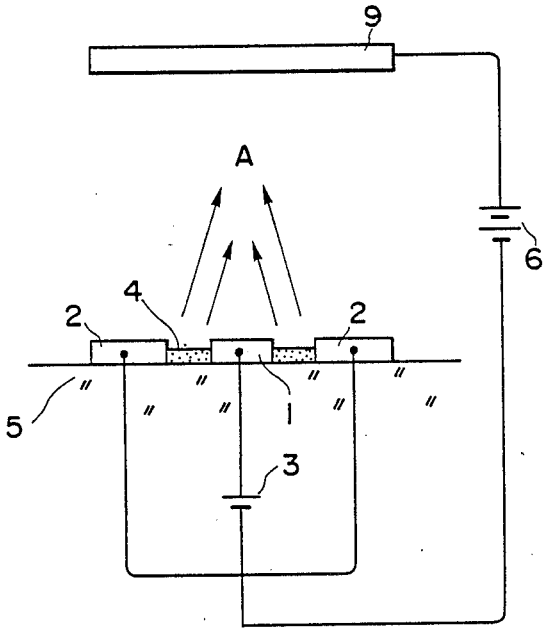
FIG. 2 is a view explanatory of how electrons are emitted from the surface conduction electron-emitting device of the present invention.
Figure 19:
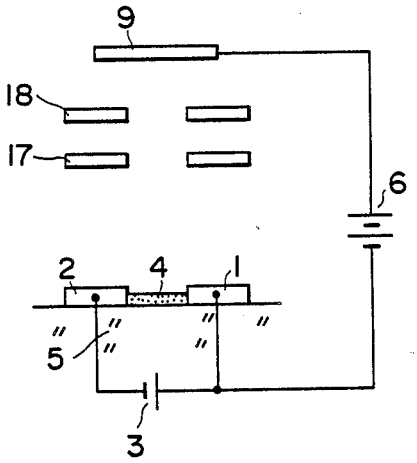
FIG. 19 PRIOR ART

FIG. 2 is a view explanatory of how electrons are emitted from the surface conduction electron-emitting device of the present invention. In FIG. 2, when a voltage is applied to an accelerating electrical source 6, electrons tend to converge to the center as a whole as indicated by arrow A. This is because the potential distribution is generated such that the electrons are inclined to focus to the high-potential side at the center since the high-potential electrode 1 has a high potential and the low-potential electrode has a low potential. For this reason, a good focusing performance can be achieved when electrons are focused to a target electrode 9 with use of the accelerating electrical source 6, even without providing any external focusing lenses such as lens electrodes 17 and 18 as illustrated in FIG. 19 of the prior art Accordingly, such a surface conduction electron-emitting device of the present invention, as having the structure that the electrodes 1 and 2 and focusing lenses 17 and 18 of the prior art have been integrated to the high-potential electrode 1 and low-potential electrode, makes it possible to bring the electrons to focus to a specific part, i.e. a vertically upper part of the center of the device.

Figure 3:
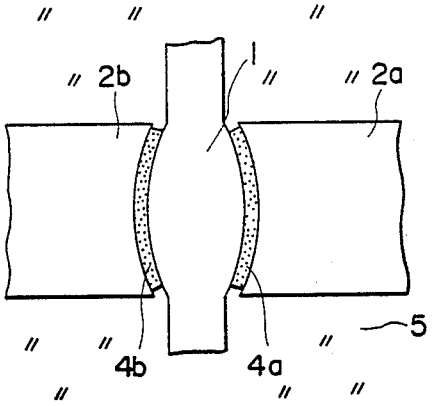
Figure 4:
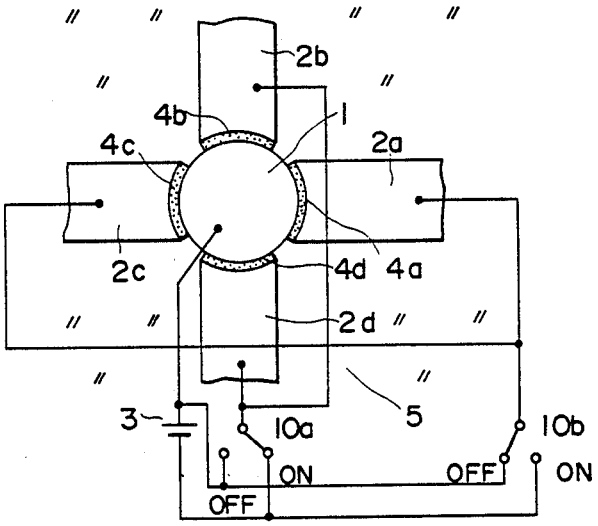
Figure 5:
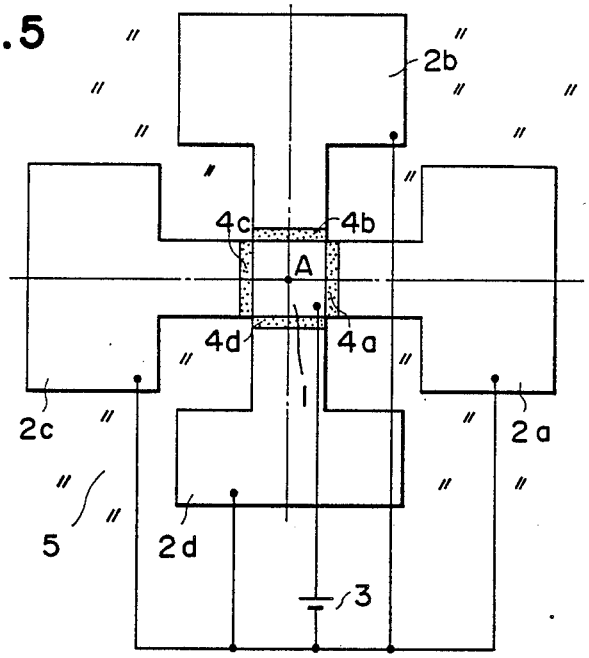

In addition, in the surface conduction electron-emitting device of the present invention, the electrodes and the electron-emitting region may not necessarily have a the round shapes. For example, the same effect as previously stated can be obtained even when as illustrated in FIG. 3, FIG. 4 and FIG. 5, the low-potential electrode is divided into a plural number of electrodes to provide a plural number of electron-emitting regions of curved or linear shapes, so long as the device basically comprises a high-potential electrode provided on a substrate surface electron emitt1ng region provided in contact with the periphery of an exposed part of the high-potential electrode, and a low potential electrode further provided in contact with the periphery of the electron-emitting region. Here, in the instance where the electron-emitting region is made to have the curved shape, the high potential electrode may preferably have a round or oval shape (as exemplified by the devices having the electron emitting region as illustrated in FIGS. 1, 3 and 4). Also, in the instance where the electron-emitting region 4 is made to have the linear shape, the high potential electrode 1 may preferably have a polygonal shape (as exemplified by those illustrated in FIG. 5).

In the surface conduction electron emitting device illustrated in FIG. 4, comprising a high-potential electrode having a round shape and a low-potential electrode made to be composed of four electrodes **2*a* to 2*d*, the device is so constituted that the low-potential electrodes 2*b* and 2*d* can be selected whether they work as low-potential electrodes (ON) or not (OFF), by means of a switch 10*a*, and, similarly, ON/OFF of the low-potential electrodes 2*a* and 2*c* can be selected by means of a switch 10*b*. Here, electron-emitting regions 4*b* and 4*d* provided between the high-potential electrode 1 and the low-potential electrodes 2*b* and 2*d* constitute one set of electron emitting regions (referred to as Set I), and, similarly, 4*a* and 4*c*** constitute one set (referred to as Set II).

The ON/OFF of the electron emitting regions of Set 1 and that of the electron-emitting regions of Set II can be selected by the switch **10*a* and switch 10*b*, respectively. Accordingly, the switch 10*b* may be kept turn off and only switch 10*a* may be turned on to drive the surface conduction electron-emitting device of the present invention. Thus, there is provided an electron-emitting device in which the center of the light-emitting region is positioned vertically above the center of the surface conduction electron emitting device of the present invention. This electron-emitting device also has a spare electron-emitting region corresponding to Set II. The spare electron-emitting region is used when the electron-emitting regions of Set 1** do not operate because of the end of the life of the electron-emitting regions.

Figure 6A:
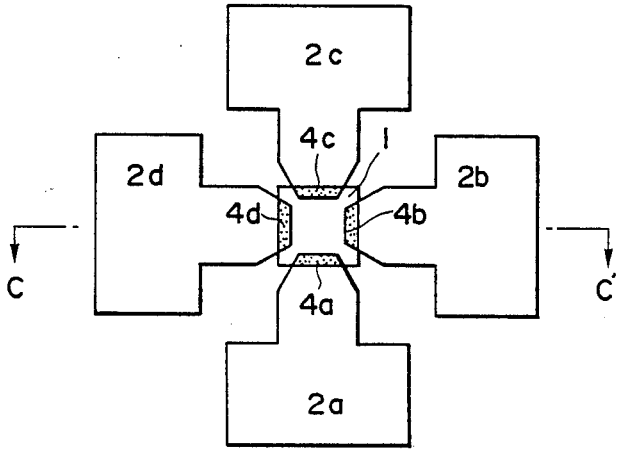
Figure 6B:
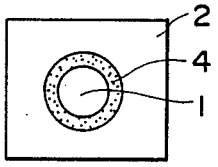
Figure 6C:
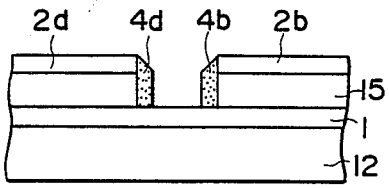

As illustrated in FIG. 6C, the surface conduction electron-emitting device of the present invention may also be a 'vertical type' surface conduction electron-emitting device comprising:

a pair of electrodes 1 and **2*b* positioned on and beneath a stepped portion of a step-forming layer 15 provided on a substrate 12, electrodes 1 and 2*b* opposing each other with the stepped portion between to have electrode spacing; and an electron-emitting region 4*b* formed at the side end face of the stepped portion positioned between said electrodes 1 and 2*b*;**

where electrons are emitted from the electron-emitting region **4*b* on applying a voltage between the electrodes 1 and 2*b*. In this embodiment also, the beam of emitted electrons can be brought to focus, so long as the device has the form, as illustrated in FIGS. 6A, 6B and 6C, comprising a high-potential electrode 1 provided on a substrate surface, electron-emitting regions 4 and 4*a* to 4*d*** provided in contact with the periphery of an exposed part of the high-potential electrode, and low-potential electrodes 2 and 2a to 2d further provided in contact with the peripheries of the electron-emitting regions 4 and 4a to 4d.

In a surface conduction electron-emitting device of the type that the low-potential electrode described above is divided into a plurality of elements so as to provide a plural number of electron-emitting regions in one device, the electron beam can also be brought to deflect in a desired direction by independently applying a different potential to each of the low-potential electrodes.

Figure 7:
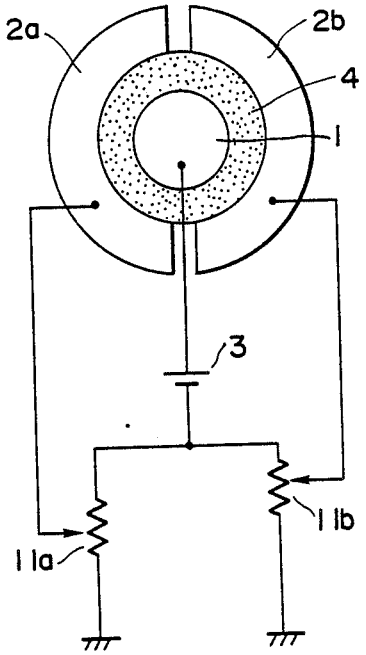

As an example thereof, as illustrated in FIG. 7, a low-potential electrode 2 is divided into two parts, 2a and 2b, to which potential Va, Vb is Independently applied. Namely, if Va>Vb, the beam deflects toward 2a, and, if Vb>Va, it deflects toward 2b. In this case, the direction and magnitude of the deflection depends on Va minus Vb, and the amount of emitted electrons and the degree of focusing substantially depend on Va plus Vb. Accordingly, both can be controlled independently. Additionally, the low-potential electrode 2 need not be divided into two parts, and can be divided into a desired number of electrodes according to the purpose of the device.

Next, in the surface conduction electron-emitting device of the present invention, the focusing performance of the electron beam can be further improved by providing a low-potential electrode in such a manner that it projects upward in the thickness direction of the substrate to a higher level than the high-potential electrode.

Figure 8A:
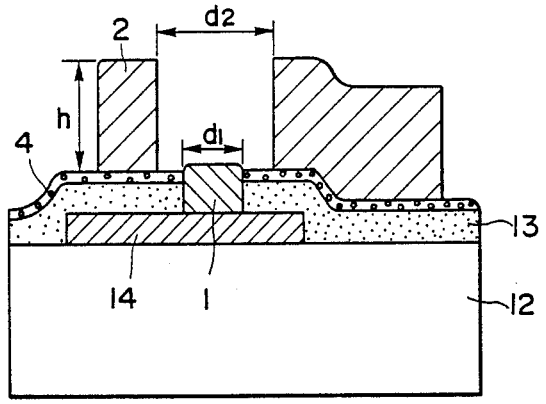
Figure 8B:
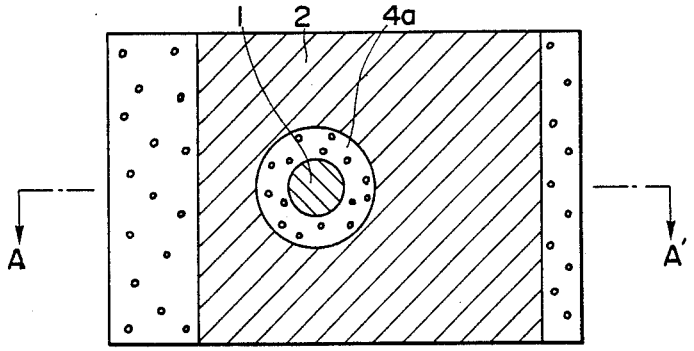

For example, as shown in FIGS. 8A and 8B, when the device has a constitution such that a high-potential electrode 1 has a round shape and is surrounded by a low-potential electrode forming a hole in which electrode 1 is positioned, the diameter $d_1$ of the high-potential electrode 1, the diameter $d_2$ of the hole defined by the low-potential electrode 2 and the height h of the hole (or the distance from the top surface of the high-potential electrode to the top surface of the low-potential electrode) may preferably satisfy the following relationship:

$$d_2-d_1 \lesssim 4\ \mu m \quad (a)$$

$$d_2/6 \lesssim h \lesssim 6\ d_2 \quad (b)$$

How the electron beam focusing performance is improved by virtue of the electrodes 1 and 2 will be described below with reference to FIGS. 9A and 9B.

Figure 9A:
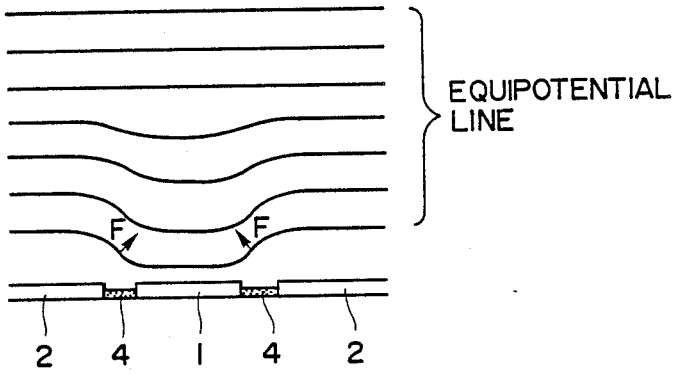
FIGS. 9A and 9B are views explanatory of how equipotential lines are formed on the surface conduction electron-emitting devices of the present invention.
Figure 9B:
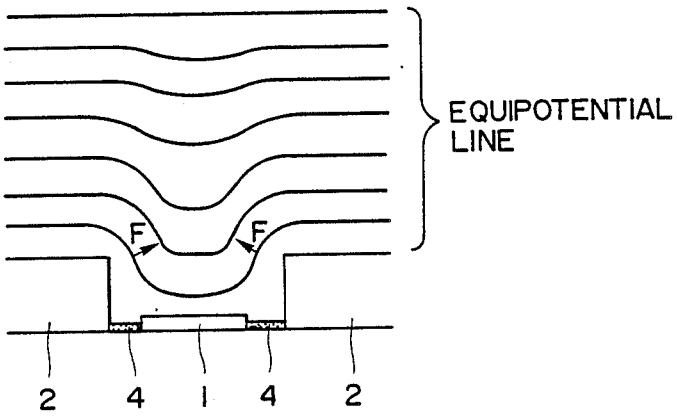

In FIGS. 9A and 9B the numeral 1 denotes a high-potential electrode; numeral 2, denotes a low-potential electrode; and numeral 4 denotes, electron-emitting region. Though not illustrated here, assume that a plane target electrode to which a positive voltage of several to several ten kV has been applied is disposed above the surface conduction electron emitting device.

FIG. 9A shows equipotential lines in the vicinity of a surface conduction electron emitting device comprising electrodes 1 and 2 both made equal in thickness; the direction of a representative force exerted to the electron beam is indicated by arrows F. Similarly, FIG. 9B shows a state in the vicinity of a surface conduction electron-emitting device comprising the low-potential electrode 2 projected upward in the thickness direction of the substrate to a higher level than the high-potential electrode 1. As will be seen by comparing these FIG. 9A and FIG. 9B, in the surface conduction electron-emitting device of the present invention, the slant of equipotential lines is greater in the case where the low-potential electrode 2 has a larger thickness than the high-potential electrode 1, as compared with that in FIG. 9A. Accordingly, the electron beam undergoes a greater focusing force toward the center at the emission initial stage in which it has a small magnitude of the velocity component toward the target electrode and is subject to influence by the electric field.

Figure 10A:
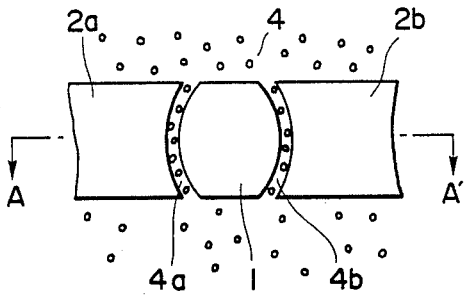
Figure 10B:
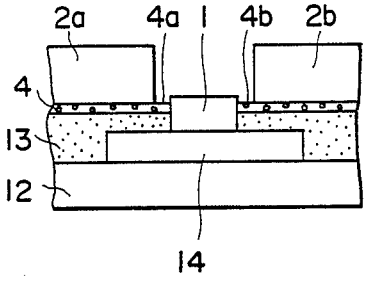
Figure 11A:
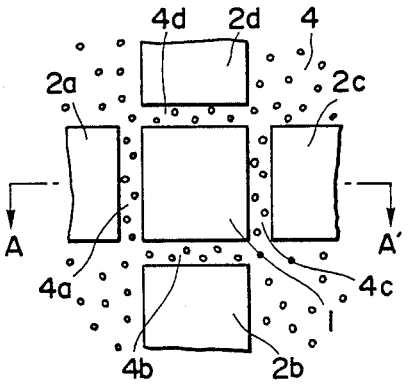
Figure 11B:
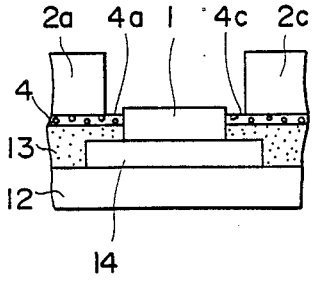
Figure 12A:
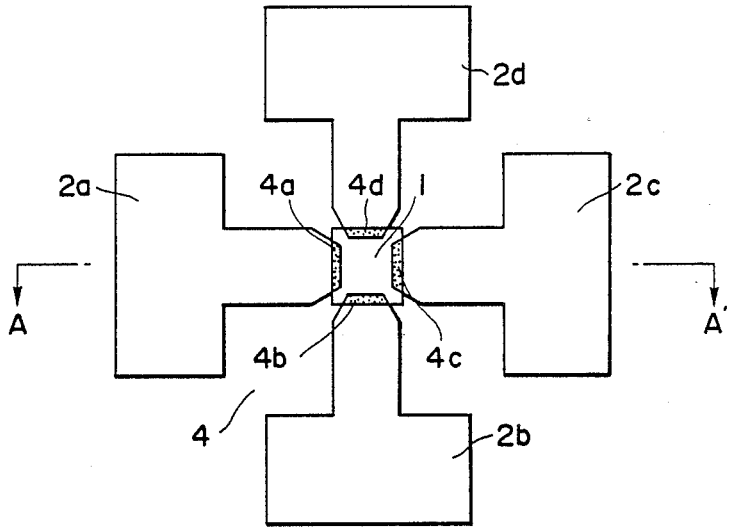
Figure 12B:
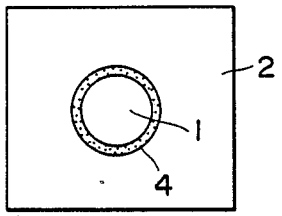

In FIGS. 8A and 8B, the electrodes and electron-emitting regions have round shapes, but the same effect as previously stated can be obtained even when as illustrated in FIG. 10, FIG. 11 and FIG. 12, the low-potential electrode is divided into a plural number of electrodes to provide a plural number of electron-emitt1ng regions of curved or linear shapes, so long as the device comprises a high-potential electrode provided on a substrate surface, an electron-emitting region provided in contact with the periphery of an exposed part of the high-potential electrode, and a low-potential electrode further provided in contact with the periphery of the electron-emitting region in such a manner that it projects upward in the thickness direction of the substrate to a higher level than the high-potential electrode.

Figure 13A:
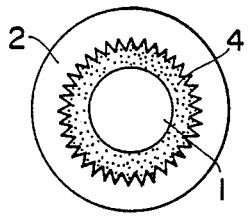
Figure 13B:
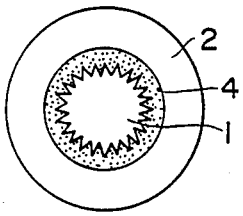
Figure 13C:
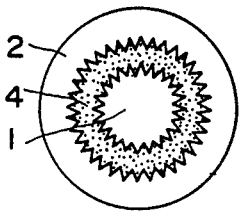
Figure 13D:
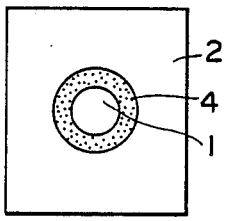

In the surface conduction electron-emitting device of the present invention, unevenness as illustrated in FIGS. 13A to 13C may further be made on at least one of the boundary between the low-potential electrode and the electron emitting region and the boundary between the high-potential electrode and the electron-emitting region. Forming the boundary in such a shape makes stronger the local electric field desirably. Also, as illustrated in FIG. 13D, the low-potential electrode 2 can be made to have any desired outer side shape according to any conditions of arrangement or wiring.

Figure 14:
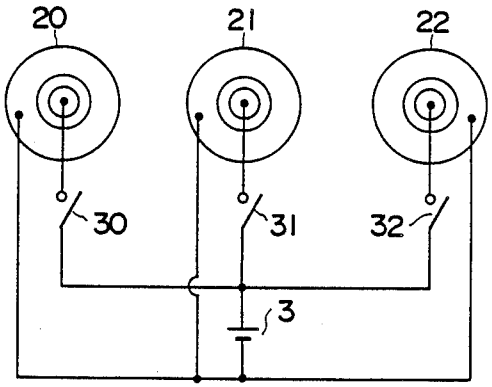

As illustrated in FIG. 14, the surface conduction electron-emitting device according to the present invention may also constitute a plural number of devices arranged on the same substrate and driven independently, so that there can be obtained a plural number of independent electron beams.

Figure 15A:
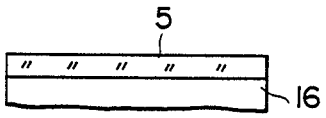
FIG. 15A to FIG. 16G are flow sheets each showing the manner by which the surface conduction electron-emitting device of the present invention is prepared.
Figure 15B:
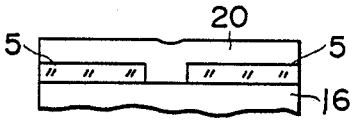
Figure 15C:
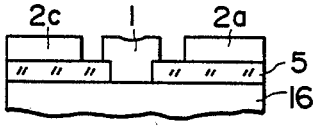
Figure 15D:
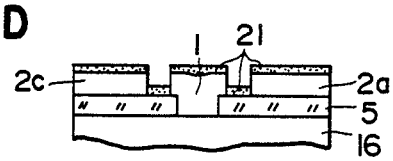
Figure 15E:
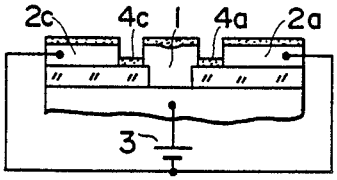

An example of methods for preparing the surface conduction electron-emitting device of the present invention will be described below with reference to FIGS. 15 and FIGS. 16. In FIGS. 15A to 15E, the surface of a substrate 16 is first oxidized to form an insulating film, thus preparing an insulating substrate 5 (FIG. 15A). Next, part of the insulating substrate 5 is etched to make a hole, and thereafter a metal film 20 is formed on the whole surface by vapor deposition (FIG. 15B). This metal film 20 is further etched as illustrated in FIG. 15C to prepare a high-potential electrode 1 and low-potential electrodes 2a and 2c. Next, a thin film 21 is formed by vapor deposition, and then a forming treatment is carried out (FIG. 15D). In this instance, unless the high-potential electrode 1 and the low-potential electrodes 2a and 2c are masked, the thin film adheres also on the top surfaces of these, but this does not affect the characteristics of the device in practical use. If necessary, however, it is of course possible to cover with a mask the top surfaces of the high-potential electrode 1 and low-potential electrodes 2a and 2c to prevent the thin film from adhering thereon. Then, application of a voltage between the low-potential electrodes 2a and 2c and the substrate 16 from an external electric source 3 brings about emission of electrons from electron-emitting regions 4a and 4c (FIG. 15E).

Figure 16A:
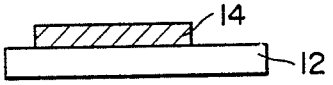
Figure 16B:
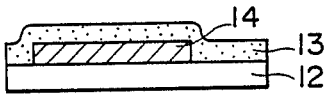
Figure 16C:
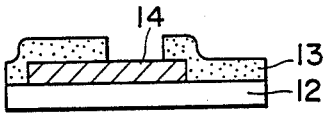
Figure 16D:
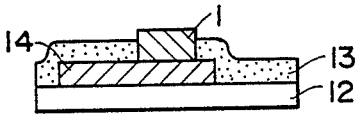
Figure 16E:
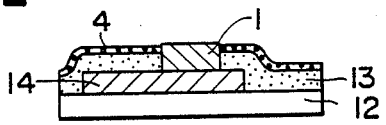
Figure 16F:
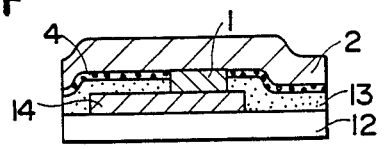
Figure 16G:
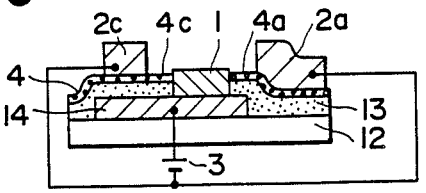

To describe another method for preparing the surface conduction electron-emitting device of the present invention, with reference to FIGS. 16A to 16G, a wiring electrode 14 is first patterned in the shape of a stripe on a substrate 12 made of glass, quartz or the like (FIG. 16A). Next, an insulating layer 13 is formed on the substrate 12 and wiring electrode 14 (FIG. 16B), and this insulating layer 13 is worked to make a hole by etching as illustrated in FIG. 16C. Subsequently, a metal film is formed by vapor deposition, followed by etching to prepare a high-potential electrode 1 (FIG. 16 D). A thin film 4 is further formed by vapor deposition and a forming treatment is carried out (FIG. 16E). Then a metal film 2 that formed the high-potential electrode 1 is formed by vapor deposition (FIG. 16F), followed by working to make a hole by etching to prepare low-potential electrode 2a and 2c (FIG. 16G).

In the above methods, electron-emitting regions 4a and 4c (FIGS. 15 and 16) are formed by vapor deposition, but, without limitation thereto, also available is a method in which a dispersion obtained by dispersing fine particles of an electron-emitting material in a dispersion medium is applied by, for example, dipping or spin coating, followed by baking. In this instance, the dispersion medium may be any of those capable of dispersing the fine particles without any change of their properties, and there may be used, for example, alcohols, methyl ethyl ketone, cyclohexane, and a mixture of any of these. The fine particles may preferably have a particle diameter of several ten angstroms to several um.

Materials for constituting the surface conduction electron-emitting device of the present invention may be any of those used in conventional surface conduction electron emitting devices. For example the substrate 16 (FIG. 15) may be made of any materials so long as they are electroconductive including n-type Si, P-Si, or metals such as Al and Cu. The high-potential electrode 1 and low-potential electrodes 2a and 2c (FIGS. 15 and 16), and also the Wiring electrode 14 (FIG. 16) may also be made of any materials so long as they are good conductors, and there can be used, for example, metals such as Cu, Pb, Ni, Al, Au, pt and Ag, and oxides such as $SnO_2$ and ITO.

The insulating substrate 8 (FIG. 15) may also be made of any materials so long as the insulating film formed thereon comprises an insulator, but what can be simple in view of preparation methods may preferably include $SiO_2$ and $Al_2O_3$ obtainable by oxidation of the substrate. Insulators such as $SiO_2$, MgO and glass are also used in the substrate 12 and insulating layer 13 (FIG. 16).

Further used in the electron emitting regions 4a, 4c (FIGS. 15 and 16) are, for example, metal oxides such as $In_2O_3$, $SnO_2$ and pbO, metals such as Ag, Pt, Al, Cu and Au, carbon, and other various semiconductors.

As for the size of each component, the high-potential electrode 1 may be made to have a size of from 1 nm to several mm, the electron emitting regions 4a and 4c may each have a width of the size corresponding to that of a conventional surface conduction electron-emitting device (for example, 1 μm to several ten mm), and the low-potential electrodes 2a and 2c may have any size.

The electron-emitting regions 4a and 4c may also each have a thickness corresponding to that of a conventional surface conduction electron-emitting device (for example, several ten Å to several μm). The high-potential electrode 1 and the low-potential electrodes 2a and 2c may have any thickness. Since, however, an excessively large thickness may cause hindrance of electron emission, the high-potential electrode 1 may desirably have a little larger thickness than the film thickness of the electron-emitting regions. The insulating substrate may have any thickness.

When the low-potential electrodes 2a and 2c are formed to have a larger thickness than the high-potential electrode 1, in order to improve the electron beam focusing, they should be formed so as to satisfy the relationship of the formulas (a) and (b) previously described.

In the case where a number of the surface conduction electron-emitting devices are provided in the arrangement, the wiring electrode 14 may be formed on the substrate 12 by patterning to have a desired shape such as a stripe on a desired position and then the high-potential electrode 1 may be provided on this wiring electrode 14 as shown in FIGS. 16, thus preferably making the device easy to manufacture.

Figure 12C:
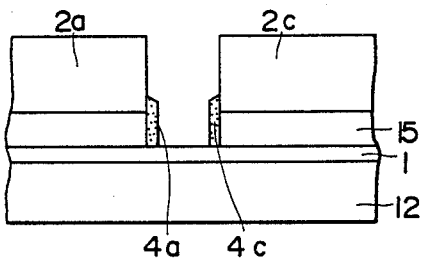

In the instance where the surface conduction electron-emitting device of the present invention has a vertical type structure previously described, an insulating material is used in general as the step-forming layer 15 as illustrated in FIG. 6C and FIG. 12C. For example, the material may be $SiO_2$, MgO, $TiO_2$, $Ta_2O_5$ and $Al_2O_3$, a laminate of any of these, or a mixture of any of these. The spacing between the electrodes 1 and 2 depends on the thickness of the step-forming layer 16 and the thickness of the electrodes 1 and 2, but may preferably be several ten angstroms to several um. Other component members may employ the same materials and constitution as those previously described.

As described above, the surface conduction electron-emitting device of the present invention comprises a high-potential electrode provided on a substrate surface, an electron-emitting region provided in contact with the periphery of an exposed part of the high-potential electrode, and a low-potential electrode further provided in contact with the periphery of the electron emitting region. It is possible to focus the electron beam to a particular position, i.e.. a spot located at the direction perendicular to the center of the device, and moreover to decrease the flickering at the light-emitting region. Also, if the low-potential electrode of the device is divided into a plural number of electrodes to provide a plural number of electron-emitting regions, it is possible for the surface conduction electron emitting device of the present invention to be provided With a spare electron-emitting region. In addition, the surface conduction electron-emitting device of the present invention, when having a constitution comprising an inside high-potential electrode and an outside low-potential electrode projecting upward in the thickness direction of a substrate, can further enhance the beam-focusing performance, make smaller the size of the electron beam on a target electrode, and make it unnecessary to provide any external focusing lenses.

EXAMPLE 1

A surface conduction electron-emitting device was prepared in a manner shown in FIGS. 15A to 15E.

The surface of an n-type Si substrate was oxidized to form an insulating film comprising $SiO_2$, and part thereof was etched to make a hole, followed by vapor deposition of an Al metal film on the whole surface The resulting deposited film was further etched to prepare high-potential and low-potential electrodes. A thin Au film was further formed thereon by vapor deposition, and a forming treatment was carried out, thus obtaining the surface conduction electron emitting devices illustrated each in FIG. 1 and FIG. 5.

Employment of this surface conduction electron-emitting device brought about a decrease in the flickering as in the prior art Here, assuming the electron electric current ejected from the surface conduction electron-emitting device as $I_e$, the swing of the electron electric current as $\Delta I_e$, and $\Delta I_e/I_e$ as an index of the flickering at the light-emitting region, the surface conduction electron-emitting device of the present invention showed about ½ flicker as compared with 16% flicker in the conventional device (FIG. 17), and the center of the light emitting spot was positioned at the direction perpendicular to the center of the surface conduction electron-emitting device.

EXAMPLE 2

Example 1 was repeated to prepare the surface conduction electron-emitting device illustrated in FIG. 3. The flickering at the light-emitting region thereof was 1/1.4 of that in the prior art. The center of the light-emitting spot was also positioned at the direction perpendicular to the center of the device.

EXAMPLE 3

Example 1 was repeated to prepare the surface conduction electron-emitting device illustrated in FIG. 4. The flickering at the light-emitting region thereof was 1/1.4 of that in the prior art. The center of the light-emitting spot was also positioned at the direction perpendicular to the center of the device.

EXAMPLE 4

A surface conduction electron-emitting device was prepared in a manner shown in FIGS. 16A to 16G.

In FIGS. 8A and 8B, the numeral 12 denotes a glass substrate, and 14 denotes a wiring electrode which is provided in a stripe pattern on the substrate 12. The material for the wiring electrode 14 was comprised of a laminate of Cr of 50 angstroms thick and Ta of 1,000 angstroms thick.

The numeral 13 denotes an insulating layer, which was formed by coating a liquid $SiO_2$ coating preparation (OCD, available from Tokyo Ohka Kogyo) to a thickness of 1 micron.

Photolithoetching was conducted to make a hole in the insulating layer 13, followed by deposition of Cu to a thickness of 1.2 μm thereon, and the copper other than that necessary for the high-potential electrode 1 was removed by photolithoetching.

Subsequently, as an electron-emitting material, a solution of an organic palladium compound (Catapaste CCP, available from Okuno Seiyaku Kogyo) was applied thereon by spinner coating. Thereafter, the coating was baked for 1 hour at 400° C. to prepare a thin film 4 having a film thickness of 1,500 angstroms and containing pd fine particles.

Next, as a low-potential electrode 2, Al was vapor deposited to a thickness of 10 μm, and, as shown in FIG. 8A and FIG. 8B, the peripheral area of the high-potential electrode 1 was removed by conventional photolithoetching. At the same time, the low-potential electrode 2 was etched to give the shape of a stripe serving also as a wiring electrode.

The diameter $d_1$ of the high-potential electrode 1, the diameter $d_2$ of the hole of the low-potential electrode 2, and the height h thereof were made to have the following relationship:

$$d_1 \sim 10\ \mu m$$
$$d_2 \sim 14\ \mu m$$
$$h \sim 10\ \mu m$$

Application of a voltage of 10 to 20 V applied between the electrode 1 and the electrode 2 brought about emission of electrons from the electron-emitting region 4a.

At an upper part of the surface conduction electron-emitting device as in the above, placed was a target electrode coated with a phosphor and applied with an accelerated voltage, and the spreading of the electron beam was measured As a result, it was confirmed that the spreading was about 3/5 with a remarkable enhancement of the focusing performance, as compared with a surface conduction electron emitting device comprising electrodes i and 2 both made equal in thickness

EXAMPLE 5

The present Example will be described making reference to FIG. 10.

In the present Example, the device was made to have the same structure as in Example 4 except that the high potential electrode 1 was held between two thick low-potential electrodes 2a and 2b from the both sides.

A remarkable enhancement of the focusing performance was confirmed also in the present Example.

EXAMPLE 6

The present Example will be described making reference to FIG. 11.

In the present Example, the device was made to have the same structure as in Example 4 except that the high-potential electrode 1 was surrounded by four thick low-potential electrodes 2a to 2d.

A remarkable enhancement of the focusing performance was confirmed also in the present Example.

We claim:

1. A surface conduction electron-emitting device comprising a high-potential electrode provided on a substrate surface, an electron-emitting region provided in contact with the entire periphery of an exposed part of said high-potential electrode, and a low-potential electrode further provided in contact with the entire periphery of said electron-emitting region.

2. The surface conduction electron-emitting device of claim 1, wherein at least one of said high-potential electrode and said low-potential electrode are uneven on the side thereof coming into contact with said electron-emitting region.

3. The surface conduction electron-emitting device of claim 1, further comprising means for applying a voltage between said high-potential electrode and said low-potential electrode, thereby causing the flowing of an electric current to said electron-emitting region and the emitting of electrons from said electron-emitting region.

4. A surface conduction electron-emitting device comprising a high-potential electrode provided on a substrate surface, an electron-emitting region provided in contact with the entire periphery of an exposed part of said high-potential electrode, and a low-potential electrode further provided in contact with the entire periphery of said electron-emitting region in such a manner that said low-potential electrode projects upward in the thickness direction of the substrate to a higher level than the high-potential electrode.

5. The surface conduction electron-emitting device of claim 4, wherein at least one of said high-potential electrode and said low-potential electrode are uneven on the side thereof coming into contact with said electron-emitting region.

6. The surface conduction electron-emitting device of claim 4, further comprising means for applying a voltage between said high-potential electrode and said low-potential electrode, thereby causing the flowing of an electric current to said electron-emitting region and the emitting of electrons from said electron-emitting region.

7. A surface conduction electron-emitting device comprising a high-potential electrode provided on a substrate surface, a plurality of electron-emitting regions provided in contact with an exposed part of said high-potential electrode so that said plurality of electron-emitting regions extend symmetrically around said exposed part, a plurality of low-potential electrodes provided in contact with the plurality of electron-emitting regions, and means for applying different potentials independently to each of said plurality of low-potential electrodes.

8. The surface conduction electron-emitting device of claim 7, wherein said plurality of electron-emitting regions emit electrons in response to the flow of an electric current to said plurality of electron-emitting regions.

9. The surface conduction electron-emitting device of claim 7, wherein said means for applying different potentials is means capable of independently adjusting the magnitude of the potential to be applied to each low-potential electrode.

10. The surface conduction electron-emitting device of claim 7, wherein said plurality of low-potential electrodes project upward in the thickness direction of the substrate to a higher level than said high-potential electrode.

11. The surface conduction electron-emitting device of claim 7, wherein at least one of said high-potential electrode and said low-potential electrode are uneven on the side thereof coming into contact with said plurality of electron-emitting regions.

12. A surface conduction electron-emitting device comprising a high-potential electrode provided on a substrate surface, a plurality of electron-emitting regions provided in contact with an exposed part of said high-potential electrode so that said plurality of electron-emitting regions extend symmetrically around said exposed part, and a low-potential electrode provided in contact with said plurality of electron-emitting regions.

13. The surface conduction electron-emitting device of claim 12, wherein at least one of said high-potential electrode and said low-potential electrode is uneven on the side thereof coming into contact with said plurality of electron-emitting regions.

14. The surface conduction electron-emitting device of claim 12, further means for applying a voltage between said high-potential electrode and said low-potential electrode, thereby causing the flowing of an electric current to said plurality of electron-emitting regions and the emitting of electrons from said plurality of electron-emitting regions.

15. The surface conduction electron-emitting device of claim 12, wherein said low-potential electrode is divided into a plurality of low-potential electrodes.

16. The surface conduction electron-emitting device of claim 15, wherein said means for applying a voltage is means for applying potentials of equal magnitude to said plurality of low-potential electrodes.

17. A surface conduction electron-emitting device comprising a high-potential electrode provided on a substrate surface, a plurality of electron-emitting regions provided in contact with an exposed part of said high-potential electrode so that said plurality of electron-emitting regions extend symmetrically around said exposed part, and a low-potential electrode provided in contact with said plurality of electron-emitting regions, wherein said low-potential electrode projects upward in the thickness direction of the substrate.

18. The surface conduction electron-emitting device of claim 17, wherein at least one of said high-potential electrode and said low-potential electrode is uneven on the side thereof coming into contact with said plurality of electron-emitting regions.

19. The surface conduction electron-emitting device of claim 17, further means for applying a voltage between said high-potential electrode and said low-potential electrode, thereby causing the flowing of an electric current to said plurality of electron-emitting regions and the emitting of electrons from said plurality of electron-emitting regions.

20. The surface conduction electron-emitting device of claim 17, wherein said low-potential electrode is divided into a plurality of low-potential electrodes.

21. The surface conduction electron-emitting device of claim 20, wherein said means for applying a voltage is means for applying potentials of equal magnitude to said plurality of low-potential electrodes.

22. A surface conduction electron-emitting device comprising:

at least one high-potential electrode provided on a substrate surface;

at least one electron-emitting region provided in contact with an exposed part of said at least one high-potential electrode; and at least one low-potential electrode provided in contact with said at least one electron-emitting region, wherein said at least one high-potential electrode, said at least one electron-emitting region, and said at least one low-potential electrode are positioned and configured so as to together comprise means for focusing electrons emitted from said at least one electron-emitting region.

* * * * *

UNITED STATES PATENT AND TRADEMARK OFFICE

CERTIFICATE OF CORRECTION

PATENT NO. : 4,956,578

DATED : September 11, 1990

INVENTOR(S) : AKIRA SHIMIZU ET AL.

It is certified that error appears in the above-identified patent and that said Letters Patent is hereby corrected as shown below:

ON THE TITLE PAGE, AT [57] ABSTRACT:

Line 10, "provided" should read --be provided--.

COLUMN 1

Line 21, "electron emitting" should read --electron-emitting-- and "has" should read --have--
Line 22, "includes" should read --include--.
Line 32, "electron" should read --electron---.
Line 36, "where a" should be deleted.

COLUMN 2

Line 4, "electron emitting" should read --electron-emitting--.
Line 20, "electron emitting" should read --electron-emitting--.
Line 35, "electrode a" should read --electrode, a--.
Line 37, "said" should be deleted.
Line 48, "potential" should read --potentials--.

COLUMN 3

Line 11, "electrode" should read --electrode 1---.
Line 19, "electron emitting" should read --electron-emitting--.
Line 29, "his" should read --has--.
Line 31, "electron" should read --electron---.
Line 46, "electrode" should read --electrode 2--.
Line 52, "art Accordingly," should read --art. Accordingly,--.
Line 63, "the round shapes." should read --a round shape.--.

UNITED STATES PATENT AND TRADEMARK OFFICE

CERTIFICATE OF CORRECTION

PATENT NO. : 4,956,578

DATED : September 11, 1990

INVENTOR(S) : AKIRA SHIMIZU ET AL.

It is certified that error appears in the above-identified patent and that said Letters Patent is hereby corrected as shown below:

COLUMN 4

Line 2, "surface electrone emittlng" should read --surface, an electron-emitting--.
Line 4, "low potential" should read --low-potential--.
Line 8, "high potential" should read --high-potential--.
Line 10, "electron emitting" should read --electron-emitting--.
Line 12, "the" should read --a--.
Line 13, "high potential" should read --high-potential--.
Line 16, "electron emitting" should read --electron-emitting--.
Line 31, "electron emitting" should read --electron-emitting--.
Line 32, "1" should read --I--.
Line 34, "turn off" should read --turned off--.
Line 40, "electron emitting" should read --electron-emitting--.
Line 44, "Set 1" should read --Set I--.
Line 57, "said" should be deleted.

COLUMN 5

Line 14, "Independently" should read --independently--.
Line 50, "9B the" should read --9B, the--.
Line 52, "electron-emitting" should read --an electron-emitting--.
Line 56, "electron emitting" should read --electron-emitting--.
Line 58, "electron emitting" should read --electron-emitting--.

UNITED STATES PATENT AND TRADEMARK OFFICE

CERTIFICATE OF CORRECTION

PATENT NO. : 4,956,578

DATED : September 11, 1990

INVENTOR(S) : AKIRA SHIMIZU ET AL.

It is certified that error appears in the above-identified patent and that said Letters Patent is hereby corrected as shown below:

COLUMN 6

Line 14, "electron-emittlng" should read --electron-emitting--.
Line 29, "electron-emitting" should read --an electron-emitting--.

COLUMN 7

Line 17, "potential electrode 2a and 2c" should read --potential electrodes 2a and 2c--.
Line 35, "electron emitting" should read --electron-emitting-- and "example" should read --example,--.
Line 37, "electroconductive" should read --electroconductive,--.
Line 40, "Wiring" should read --wiring--.
Line 43, "pt" should read --Pt--.
Line 45, "insulating substrate 8" should read --insulating substrate 5--.
Line 52, "electron emitting" should read --electron-emitting--.
Line 54, "pbO," should read --PbO,--.
Line 58, "electron emitting" should read --electron-emitting--.

UNITED STATES PATENT AND TRADEMARK OFFICE

CERTIFICATE OF CORRECTION

PATENT NO. : 4,956,578

DATED : September 11, 1990

INVENTOR(S) : AKIRA SHIMIZU ET AL.

It is certified that error appears in the above-identified patent and that said Letters Patent is hereby corrected as shown below:

COLUMN 8

Line 13, "the" should read --this--.
Line 28, "step-forming layer 16" should read --step-forming layer 15--.
Line 39, "electron" should read --electron---.
Line 47, "electron emitting" should read --electron-emitting--.
Line 48, "With" should read --with--.
Line 65, "surface The" should read --surface. The--.

COLUMN 9

Line 2, "electron emitting" should read --electron-emitting--.
Line 6, "art Here," should read --art. Here,--.
Line 14, "light emitting" should read --light-emitting--.
Line 59, "pd" should read --Pd--.

COLUMN 10

Line 14, "placed was" should read --was placed--.
Line 17, "measured As" should read --measured. As--.
Line 20, "electron emitting" should read --electron-emitting--.
Line 21, "electrodes i and 2" should read --electrodes 1 and 2--.
Line 22, "ness" should read --ness.--.

UNITED STATES PATENT AND TRADEMARK OFFICE

CERTIFICATE OF CORRECTION

PATENT NO. : 4,956,578

DATED : September 11, 1990

INVENTOR(S) : AKIRA SHIMIZU ET AL.

It is certified that error appears in the above-identified patent and that said Letters Patent is hereby corrected as shown below:

COLUMN 12

Line 2, "further" should read --further comprising--.
Line 31, "further" should read --further comprising--.

Signed and Sealed this

Eighth Day of December, 1992

*Attest:*

DOUGLAS B. COMER

*Attesting Officer*

*Acting Commissioner of Patents and Trademarks*